United States Patent [19]

Arnold et al.

[11] 4,422,577

[45] Dec. 27, 1983

[54] ELECTROSTATIC SPRAYING

[75] Inventors: Arthur J. Arnold, Harpenden; Barry J. Rye, Luton, both of England

[73] Assignee: National Research Development Corporation, London, England

[21] Appl. No.: 288,372

[22] Filed: Jul. 30, 1981

[30] Foreign Application Priority Data

Aug. 6, 1980 [GB] United Kingdom ..... 8025570

[51] Int. Cl.[3] ..... B05B 5/04

[52] U.S. Cl. ..... 239/703

[58] Field of Search ..... 239/700, 701, 702, 703, 239/223, 224, 706

[56] References Cited

U.S. PATENT DOCUMENTS

| | | | |
|---|---|---|---|
| 2,784,351 | 3/1957 | Renner | 239/703 X |
| 2,901,177 | 8/1959 | Norris | 239/703 |
| 4,258,409 | 3/1981 | Porter | 239/706 X |
| 4,275,838 | 6/1981 | Fangmeyer | 239/703 X |

FOREIGN PATENT DOCUMENTS

| | | | |
|---|---|---|---|
| 2839013 | 3/1979 | Fed. Rep. of Germany | 239/223 |
| 923392 | 4/1963 | United Kingdom . | |
| 1435181 | 5/1976 | United Kingdom . | |

OTHER PUBLICATIONS

A. J. Arnold & B. J. Pye "Spray Application with Charged Rotary Atomisers" Monograph 24, May 1980, British Protection Council, 7/30/81, pp. 109–117.

*Primary Examiner*—John J. Love
*Assistant Examiner*—Mary E. McCarthy
*Attorney, Agent, or Firm*—Cushman, Darby & Cushman

[57] ABSTRACT

An electrostatic spraying nozzle, particularly for agricultural use, provides for a high rate of liquid delivery, up to 6 or 7 mL/s, while maintaining uniform charging of the atomized spray by means of a low-current supply. Atomization is produced centrifugally from a conical rotor and the liquid is charged by contact with an electrically isolated conductive coating on the surface of the rotor. The coating is raised to the potential of a high-voltage needle electrode by conduction through one or more air-gaps between the needle point and the conductive surface. The conductive surface is of sufficient extent in relation to the position of the electrode to shield the electrode from any external surface at earth potential and thus to ensure that only the required charging current is passed by the electrode. A shielding action is produced by a relatively deep conical form which also allows a high flow rate. For a frustro-conical surface of apical angle 60° a ratio of end radii in the range 0.85 to 0.4 provides flow rates over the range 1:3.

13 Claims, 5 Drawing Figures

ELECTROSTATIC SPRAYING

This invention relates to apparatus for electrostatic spraying particularly for the application of electrostatically charged atomised liquids to growing crops.

It is known that liquid solutions or dispersions of insecticides and other materials for application to the foliage of plants can be most effectively and economically applied in the form of electrically charged drops. In known forms of apparatus atomisation is produced by spinning the liquid from the edge of a shallow rotating dish and the atomised material is then charged by exposure to a corona discharge. At the same time the electrostatic forces on the liquid surface act to determine the size of the atomised droplets. The discharge is produced by maintaining the dish (if metallic) or an adjacent electrode at a high potential. The edge of the dish or the electrode is sharply radiused to cause intense ionisation of the surrounding air and some of the ions become attached to the liquid droplets. A field also extends between the electrode and the ground which is a useful factor in controlling deposition of the charged droplets but results in a direct leakage of ions from the discharge to earth and to any other nearby object at earth potential. Consequently the process of charging by corona requires for only a small device a power supply capable of delivering a current of many tens of $\mu$A, little of which is represented by the charge transport of the liquid. A further consequence of this charging mechanism is that great difficulty is experienced in increasing the rate of liquid flow while maintaining the desired small drop size and uniformity of charge. If the attempted solution is to increase the size of the rotating dish with a corresponding expansion of the charging region the current flow tends to become impracticably high.

It is an object of the invention to provide electrostatic spraying apparatus suitable for ranges of delivery rates which extend to the high rates associated with tractor or aerial spraying and in which the current drain is much lower than would be estimated for corona charging at comparable delivery rates.

In accordance with the invention there is provided apparatus for the electrostatic spraying of liquid comprising a high capacity nozzle having inlet means for admitting a supply of liquid, a rotatable member having an internal liquid distribution surface disposed in use about a substantially vertical axis to receive the liquid at a first level such that on rotation the liquid is centrifugally atomised from a circumferential edge of the member at a second level higher than the first level, at least a part of the distribution surface between the first and second levels being conductive and the conductive surface being substantially electrically isolated, and electrode means so disposed within the rotatable member that conduction occurs in an air path between the electrode means and the conductive surface such that the conductive surface is maintained substantially at the electrode potential, the conductive surface being of such extent relative to the position of the electrode means that the electrode means is substantially shielded from any direct leakage path to a surface at earth potential and the flow of liquid over the conductive surface being effective to charge the liquid before atomisation.

Preferably the conductive surface extends to the circumferential edge.

The electrode means may comprise a needle or a blade and the point or edge may be spaced apart from the conductive surface by a gap not exceeding 5 mm.

The air path in this case is constituted by a single air gap.

The air path may alternatively include a plurality of air gaps with intervening isolated conductive elements.

Thus the inlet means may include a rotatable inlet member from which the liquid is delivered centrifugally to the distribution surface and the inlet member may have a further conductive surface over which the liquid flows, the electrode means being spaced apart from the further conductive surface to provide an air gap and the further conductive surface being spaced apart from the conductive surface to provide a further air gap.

The first level and the second level may define a conical surface of constant angle. The ratio of the radii at the first level and at the second level for a surface of apical angle 60° may extend in a range at least from 0.85 to 0.4, the corresponding range of flow capacity for which uniformity of drop size and charge is maintained having limits in the ratio of at least 3:1.

The invention thus envisages an arrangement for charging in which there is no direct connection between the electrode and the conductive substrate by means of which the liquid is charged nor is there any visible corona discharge. Instead, the geometry of the electrode and the conductive conical surface is made such that the field to earth due to the electrode potential is intercepted by the surface. The current flow from the electrode is then very nearly the quantity corresponding to the charge transported to earth by the atomised liquid. It will also be shown that a change in geometical scaling, essentially using a deep cone in place of the shallow dish which is known for corona devices, enables such uniform low-current charging to be achieved whilst maintaining flow stability at high rates of throughput.

The nature of the invention will be further explained and particular embodiments will be described with reference to the accompanying drawings in which.

Figure 1:
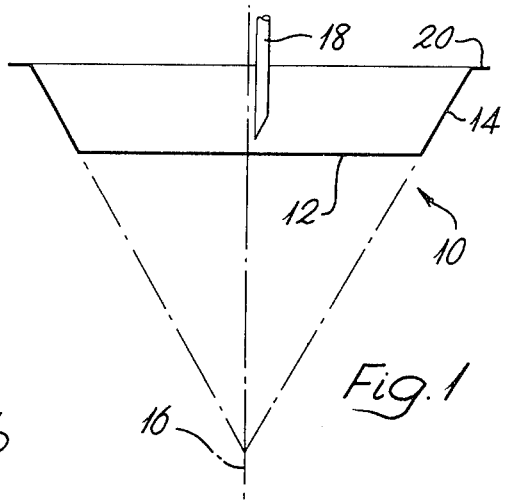
FIG. 1 illustrates the geometry of a conventional spraying head.

FIG. 1 illustrates the geometry of a conventional (non-electrostatic) centrifugal spraying head comprising an upward facing conical dish 10 having a base 12 and an outwardly sloping sidewall 14. Dish 10 is rotatable about an axis 16 and is supplied with liquid by means of a pipe 18. The liquid is delivered close to the centre of base 12 as an aid to uniform distribution. The sidewall 14 is inclined at about 60° to the base 12 so that the liquid layer is uniformly thinned in advancing over the relatively steep surface before being released at a sharp lip 20 in which wall 14 terminates.

For the purposes of a preliminary estimate of the flow conditions in the spraying head of FIG. 1 the liquid layer over the conical surface of sidewall 14 will be assumed to be of uniform thickness. It will be further assumed that the presence and maintenance of such a layer is a condition of stability. The area and similarly the volume of the layer distributed over the surface of a 60° cone is proportional to $2\pi(r_1^2-r_2^2)$ where $r_1$ is the radius of the cone in the plane of the lip 20 and $r_2$ is the radius of the base 12. The circumference of the lip 20 is close to $2\pi r_1$ so that, omitting a proportionality factor representing the speed of rotation, the volume of liquid atomised per unit length of lip per second (or flow rate, denoted hereinafter by K) is proportional to $(r_1^2-r_2^2)/r_1$.

Figure 2:
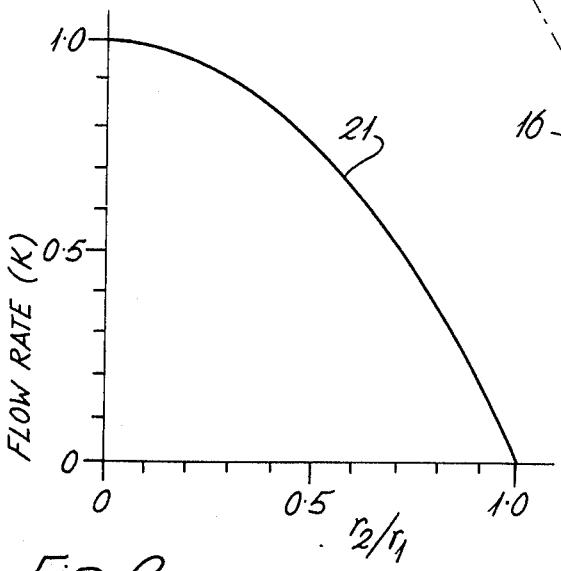
FIG. 2 is a graph relating flow rate to the geometrical parameters of the head of FIG. 1.

In curve 21 of FIG. 2 the rate of atomisation is plotted as a function of the ratio $r_2/r_1$ for a 60° cone. In order to increase the rate it will be seen to be advantageous to increase the extent of the conical surface at least until $r_2/r_1$ falls to 0.5 but that a further reduction in $r_2$ is of diminishing benefit. For any selected design point on curve 21 the atomisation rate per unit length of lip is of course enhanced in proportion to $r_1$ to obtain the total flow capacity around the circumference but the freedom to increase the radius of the dish is in practice limited by the need to provide stable rotation at high speed.

Figure 3:
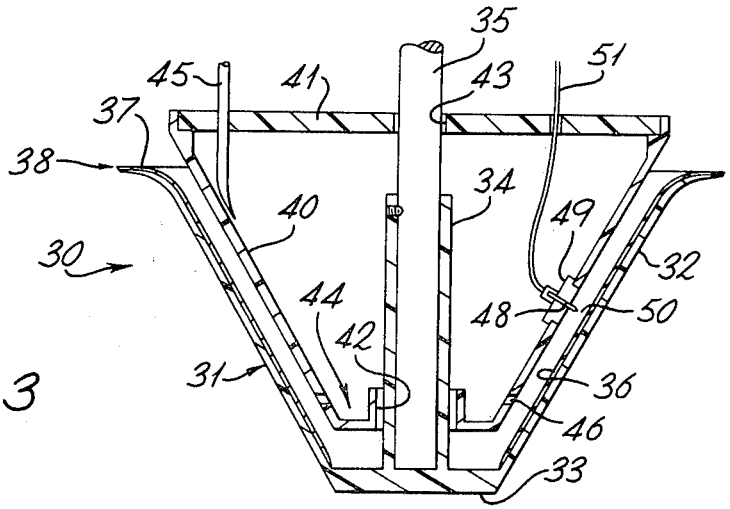
FIG. 3 represents diagrammatically a spraying head in accordance with the invention.

With reference to FIG. 3, the conclusion derived from curve 21 of FIG. 2 is applied in the design of a spraying head 30. A frustro-conical shell 31 made from a rigid, insulating, plastics material has a relatively thin sidewall 32 and a relatively thick base 33. A tube 34 of the same material as shell 31 is moulded into the base to extend axially for the full height of shell 31. A drive shaft 35 fits closely into the bore of tube 34 so that shell 31 can be rotated by coupling the free end of shaft 35 to an electric motor (not shown). The inner surface of sidewall 32 is vertically ribbed as an aid to uniform distribution of liquid and is rendered conductive by applying a metallic layer 36 such as a coating of evaporated copper. The upper free edge of sidewall 32 is turned slightly outwardly to provide a smooth transition from the inner surface to a short horizontal face 37 terminating in a sharp lip 38. The metallic coating 36 extends from wall 32 and over face 37 to lip 38. For comparison with the discussion of FIG. 2, the radius of shell 31 at the transition to face 37 corresponds to $r_1$ and the radius at the lower level to which liquid is fed corresponds to $r_2$. The alternative arrangements which are to be described for the supply of liquid provide a ratio $r_2/r_1=0.5$.

In the construction shown in FIG. 3 a second frustro-conical shell 40 is suspended inside shell 31 from a cover plate 41. An annular gap of a few mm. is left between the shells. Shell 40 and plate 41 remain static and both have clearance holes, 42, 43 respectively, for the tube 31 and drive shaft 35. The base of shell 40 is formed into a trough 44 which encloses hole 42. Plate 41 is carried by the static mounting of the drive motor and is pierced to admit liquid supply pipes 45. Shell 40, plate 41 and pipes 45 are all made from insulating material. Liquid from pipes 45 falls on to the inner surfaces of shell 40 and runs down to the trough 44 from which it overflows on to the inner surface of wall 32 through holes 46 spaced round the trough 44. On rotation of shaft 35 to drive shell 31 liquid is forced to move up wall 32 and is atomised at lip 38. The extent of any splashing, if for instance the nozzle is mounted on a vehicle which is operating on rough ground, is limited by the narrow gap between the shells.

At a position in the wall of shell 40 corresponding to about the mid-height of metallic coating 36 a needle electrode 48 is mounted in an insulating bushing 49. Only the tip of needle 48 is exposed and is set normally to the wall 32 to leave an air gap 50 of 2 mm from coating 36. A high voltage supply is connected to electrode 48 by means of a heavily insulated lead-in 51 which passed through plate 41 to the inside of shell 40.

Figure 4:
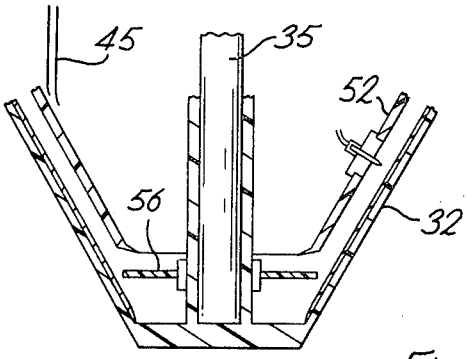
FIG. 4 represents diagrammatically a detail of an alternative construction of the head shown in FIG. 3.

An alternative liquid inlet arrangement is shown in FIG. 4 as a modification of the structure of FIG. 3. A shell 52 is a further truncated form of shell 40 which terminates at a level slightly above the desired value of $r_2$. Slightly below that level an annular liquid distributor 56 is mounted on tube 34. Distributor 56 is shown as a planar radial flange but the upper surface might alternatively be given a slight upward inclination. Liquid flowing down the inside surface of shell 52 falls on to distributor 56 which rotates with shell 31 so that liquid is spun outwards on to wall 32. The initial distribution of liquid is more uniform in this way than when the overflow trough 44 is used.

Figure 5:
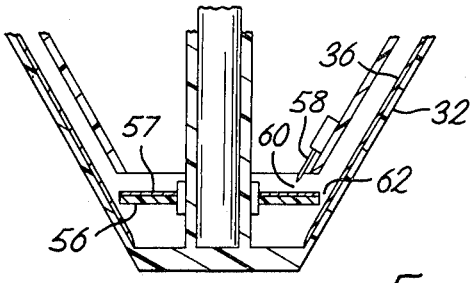
FIG. 5 represents diagrammatically a modification to the construction of FIG. 4.

In the configuration of FIG. 4 the upper surface of distributor 56 carries a layer of liquid which at least towards the outer edge becomes uniformly distributed. The charging process can therefore be initiated at this stage by modifying the structure as shown in the detail of FIG. 5. The surface of distributor 56 carries a metallic coating 57 and electrode 48 of FIG. 3 is replaced by a similarly mounted electrode 58 pointing downwards from the lower end of shell 51 to leave an air gap 60 of 2 mm from coating 57. The diameter of distributor 56 is such that an annular air gap 62 similar to the gaps 50 and 60 is created between distributor 56 and wall 32 and therefore between the respective metallic coatings 57 and 36.

In operation the process of charging is thought to depend upon the setting up of a low-current discharge in a controlled path from a high voltage electrode to earth instead of the uncontrolled and distributed paths associated with a visible corona discharge at a much higher current. In the embodiment of FIG. 3 electrode 48 is shielded from the shortest path to earth by coating 36. Particularly when the conical shell 31 is deepened to increase the flow capacity of the head the shielding effect can readily be envisaged but it is considered that the advantageous effect will still be found for larger values of $r_2/r_1$ provided $r_1$ is such that the slant height of the conductive wall coating 36 is large compared with the air gap 50 to the electrode. The conductive coating 36, typically a painted or plated metallic layer, will terminate in sharp edges, particularly when the coating extends to the lip 38 and these edges determine discharge sites from the coating to earth. The whole discharge path is therefore made up of the short air gap 50 and the long path to earth from lip 38 and consequently the potential of coating 36 becomes very close to that of electrode 48. Liquid flowing over coating 36 therefore becomes charged. In the modified form of FIG. 5 the path includes the electrode air gap 60, which corresponds to gap 50, and additionally the gap 62 between the conductive surfaces 57 and 36. Both surfaces 57 and 36 are then maintained at a potential close to that of electrode 58 and liquid in contact with either surface will accumulate charge. In respect of the discharge path there is no difference in principle between a single air-conduction gap and a number of small gaps interspaced by conductive elements. For purposes of shielding from earth or convenience of assembly, electrode 58 can therefore be located comparatively remotely from the ultimate point of emission of the charged atomised spray from the nozzle. The use of the intermediate conductive surface 36 is one example of the application of this principle.

In the absence of liquid, conduction is maintained in the air-gaps at a current of only a fraction of 1 $\mu$A. When liquid is flowing, the charge transported by the liquid must be supplied and this quantity will depend on the dielectric constant of the liquid. An estimate may be made for typical rates of flow, as follows. If the liquid is an oil-based formulation, such as may be used to limit evaporation in open-air spraying, a useful value of the charge: mass ratio would be $10^{-3}$ coulomb/kg. A flow rate of 1mL/S corresponds to 1 kg in 1000 secs (assuming a specific gravity of unity) and the rate of supply of charge is thus 1$\mu$A. Such a flow rate would be adequate for many applications and the highest flow rates of interest would not exceed 6 or 7 mL/S with a current of 6 or 7$\mu$A.

Water-based formulations may be used in glasshouses or other confined locations as well as in the treatment of field crops. The value of dielectric constant to be applied is very uncertain but on the basis of experience with such materials the current might be expected to increase by a factor of ten. The current would then be 10 $\mu$A/mL/S. but it is unlikely that high rates of flow would be required.

A controlled path charging system has been described which is suitable for a wide range of flow capacities and is particularly advantageous at the higher values. The range will be indicated by a few examples for which the heading 'flow capacity' represents the product $r_1 \times K$ (K from FIG. 2).

| $r_1$ (mm) | Depth of dish (mm) | $r_2/r_1$ | K | Flow capacity |
|---|---|---|---|---|
| 25 | 6.5 | 0.85 | 0.28 | 7.00 |
| 25 | 26 | 0.4 | 0.85 | 21.25 |
| 50 | 13 | 0.85 | 0.28 | 14.00 |
| 50 | 53 | 0.4 | 0.85 | 42.5 |

The relationships are simple and it will be clear that for each value of $r_1$ a range of 3:1 in capacity is available between the deepest and the shallowest dishes that would reasonably be used. By doubling the radius $r_1$ the capacity for each value of $r_2/r_1$ is doubled. Each unit of flow capcity might represent an actual capacity between 0.1 and 0.2 mL/S for a dish rotated at 5000 r.p.m. The rate of rotation must be determined to satisfy the desired rate of flow and drop size.

All estimates have been made with reference, for simplicity of calculation, to a conical surface of 60° apical angle but similar trends would be observed for other angles. The advantages of deepening the cone would of course be reduced if the angle were much larger.

The shape of the electrode and the extent of the associated air gap are not limited to those described. There is however no likely advantage in departing from the needle point electrode for the range of current values discussed. A short blade would be suitable if higher values were encountered.

The inner static cone is not essential for the operation of the device and alternative means of feeding in liquid and of mounting the electrode can be arranged.

We claim:

1. Apparatus for the electrostatic spraying of liquid comprising a high capcity nozzle having: inlet means for admitting a supply of liquid; a rotatable member having an internal liquid distribution surface disposed in use about a substantially vertical axis to receive the liquid at a first level such that on rotation the liquid is centrifugally atomised from a circumferential edge of the member at a second level higher than the first level, at least a part of the distribution surface between the first and second levels being conductive and the conductive surface being substantially electrically isolated from metallic electrical connection; and electrode means so spaced within the rotatable member that conduction occurs in an air path between the electrode means and the conductive surface such that the conductive surface is maintained substantially at the electrode potential, the conductive surface being of such extent relative to the position of the electrode means that the electrode means is substantially shielded from any direct leakage path to an external surface at earth potential and the flow of liquid over the conductive surface being effective to charge the liquid before atomisation.

2. Apparatus according to claim 1 in which the conductive surface extends to the circumferential edge.

3. Apparatus according to claim 1 or claim 2 in which the air path is constituted by a single air-conduction gap, the electrode means being spaced apart from the conductive surface by a gap not exceeding 5 mm.

4. Apparatus according to claim 3 in which the air-conduction gap is operative at substantially the mid-height of the conductive surface.

5. Apparatus according to claim 1 or claim 2 in which the air path is constituted by a plurality of air-conduction gaps with intervening isolated conductive elements.

6. Apparatus according to claim 5 in which the inlet means includes a rotatable inlet member from which the liquid is delivered centrifugally to the distribution surface, the inlet member having a further conductive surface over which the liquid flows, the electrode means being spaced apart from the further conductive surface to provide an air-conduction gap and the further conductive surface being spaced apart from the conductive surface to provide a further air-conduction gap.

7. Apparatus according to claim 1 or claim 2 in which the portion of the electrode means which defines an air-conduction gap comprises the point of a needle.

8. Apparatus according to claim 1 or claim 2 in which the portion of the electrode means which defines an air-conduction gap comprises the edge of a blade.

9. Apparatus according to claim 1 or claim 2 in which the distribution surface is a conical surface of constant angle and the first level has a smaller circumferential edge than the second level.

10. Apparatus according to claim 9 in which the ratio of the radii at the first level and at the second level for a surface of apical angle 60° is selected from the range 0.85 to 0.4, in dependence on the required flow capacity.

11. Apparatus according to claim 1 or claim 2 in which the inlet means includes a rotatable inlet member from which the liquid is delivered centrifugally to the distribution surface.

12. Apparatus according to claim 1 or claimm 2 in which the inlet means includes a static inlet member forming a circularly symmetric trough to receive liquid, the walls of the trough having overflow ports adjacent to the distribution surface at the first level.

13. Apparatus according to claim 12 in which the static inlet member comprises a frustro-conical shell forming said trough at the end of the shell of smaller diameter, the inner surface of the shell serving to convey incoming liquid and the electrode being mounted in the wall of the shell.

* * * * *